United States Patent [19]

Soika et al.

[11] 4,144,793

[45] Mar. 20, 1979

[54] STRINGED INSTRUMENT CONSTRUCTION EMPLOYING AN INTEGRAL, HOLLOW, ONE PIECE BODY PORTION

[76] Inventors: Emil H. Soika, 2312 E. Grand Ave., Lindenhurst, Ill. 60046; Robert R. Genc, 117 E. Grove, Mundelein, Ill. 60060

[21] Appl. No.: 808,191

[22] Filed: Jun. 20, 1977

[51] Int. Cl.[2] ..... G10D 1/08; G10D 3/02

[52] U.S. Cl. ..... 84/291; 84/293

[58] Field of Search ..... 84/291, 293

[56] References Cited

U.S. PATENT DOCUMENTS

| | | | |
|---|---|---|---|
| 2,793,556 | 5/1957 | Maccaferri | 84/293 X |
| 3,186,288 | 6/1965 | Finch | 84/291 |
| 3,538,807 | 11/1970 | Francis | 84/293 |
| 3,691,285 | 9/1972 | Larrison | 84/293 |
| 3,696,700 | 10/1972 | Berardi | 84/291 |

*Primary Examiner*—Lawrence R. Franklin

*Attorney, Agent, or Firm*—Gildo E. Fato

[57] ABSTRACT

Described is a stringed instrument construction, particularly a guitar construction, including a seamless, hollow, one piece body portion or sound box molded from a synthetic material. The body can be molded by conventional spin or roto casting techniques. The body portion or sound box is acoustic and can therefore be used for either an electric type instrument or a conventional manual or acoustic type instrument. A neck construction is also described comprising a metal and hardwood laminate which does not allow any significant deflection due to string load.

5 Claims, 7 Drawing Figures

10
20
21
22
23
24
25
26
27
28
29
30
31
32
35
36
38
40
46
47
48
6
6

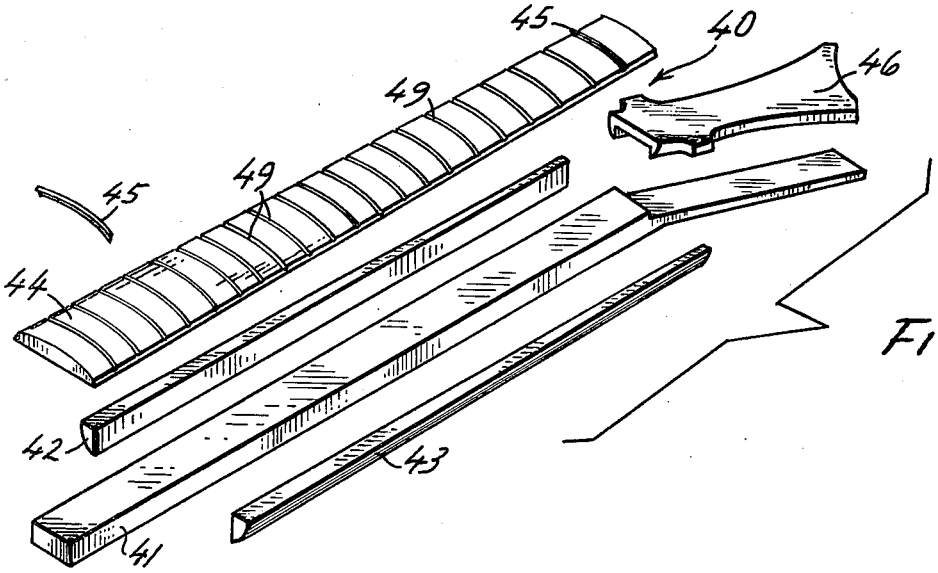
FIG. 4.
FIG. 5.
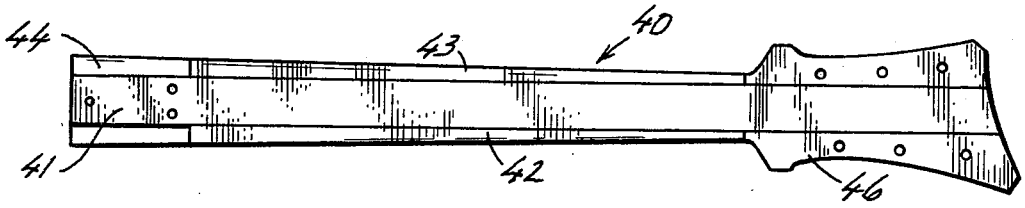
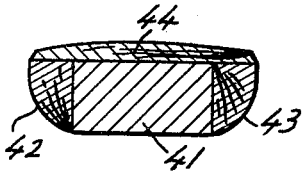
FIG. 6.
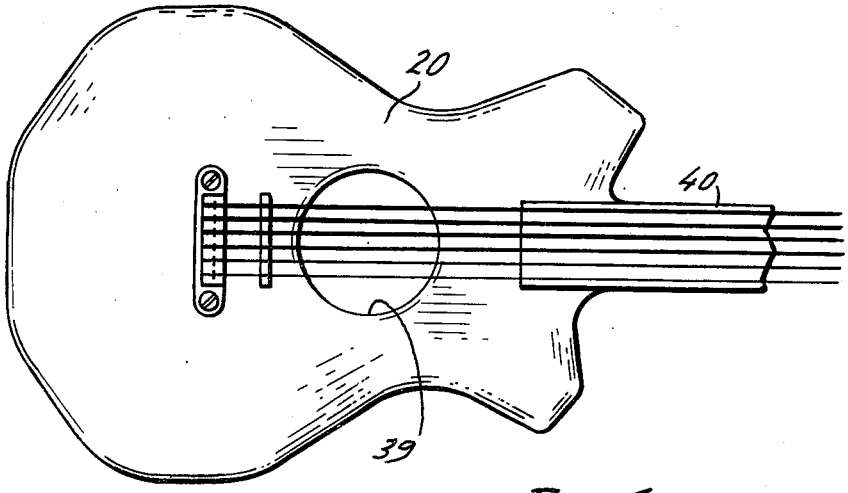
FIG. 7

STRINGED INSTRUMENT CONSTRUCTION EMPLOYING AN INTEGRAL, HOLLOW, ONE PIECE BODY PORTION

BACKGROUND OF THE INVENTION

Guitar or stringed instrument construction has typically employed wood for construction of both the body or sound box portion and the neck portion. Typically, the sound box has been made from a plurality of pieces of wood which are formed and arranged using conventional wood working techniques into the sound box arrangement and glued together. Likewise, the neck portion has been made of wood. The neck portion, under a string load, tends to bow or bend. Consequently, truss or compression rods always fabricated from steel, have been formed into the neck portion to eliminate or minimize the bowing due to the string load during use. The body portion of electric guitars, which need not have any acoustic capabilities, have been made from a solid block of wood which is formed and shaped by conventional wood working techniques into the body of the guitar. Such manufacturing techniques for either the manual or electric type guitars, are labor intensive and require expensive materials. Hence, these manufacturing techniques contribute to the cost of the guitars.

U.S. Pat. No. 3,911,778, issued Oct. 14, 1975, for Guitar Construction, describes a guitar having a two-piece sound box defined by one piece molded body of bowl shape and a top board for enclosing the bowl. The bowl shaped portion of the body is cast in a two-part mold from polyester fiberglass sheet molding compound. The neck portion of the guitar is made from an aluminum casting having a plastic back. While the construction described in this patent is advantageous, the body portion or sound box comprises two parts which must be joined together.

SUMMARY OF THE INVENTION

Described is a guitar or stringed instrument construction, including a seamless, hollow, one piece body portion or sound box molded from a synthetic material such as polyester, polyurethane, epoxy, and the like. The body can be molded by conventional spin or roto casting techniques which is accomplished by rotating a mold about two axes simultaneously. The material is initially in a liquid state and is converted into a solid by the addition of a catalyst immediately prior to spinning. The neck portion is constructed from a laminated hardwood and aluminum combination so as to produce a rigid member which supports the string load without the need of a truss or compression rod. The metal and hardwood laminate construction does not allow any significant deflection and prevents distortion due to moisture. The seamless hollow one-piece body portion or sound box is acoustic and may be played with or without the addition of sound transducers, i.e., magnetic pickups, crystal pickups, microphones and the like. Consequently, a stringed instrument such as either a conventional manual guitar or an electric guitar may be produced from the same basic component.

BRIEF DESCRIPTION OF THE DRAWINGS

The invention will be better understood with reference to the following drawings in which:

FIG. 4 is an exploded perspective view of a neck embodiment of the present invention;

FIG. 5 is a bottom plan view illustrating the neck in an assembled relationship;

FIG. 6 is a cross-sectional view taken along the line 6—6 in FIG. 1 of the neck in an assembled relationship; and FIG. 7 is a top plan view of a sound box of the present invention including a sound opening.

DETAILED DESCRIPTION OF THE INVENTION

Figures 1, 2, 3:
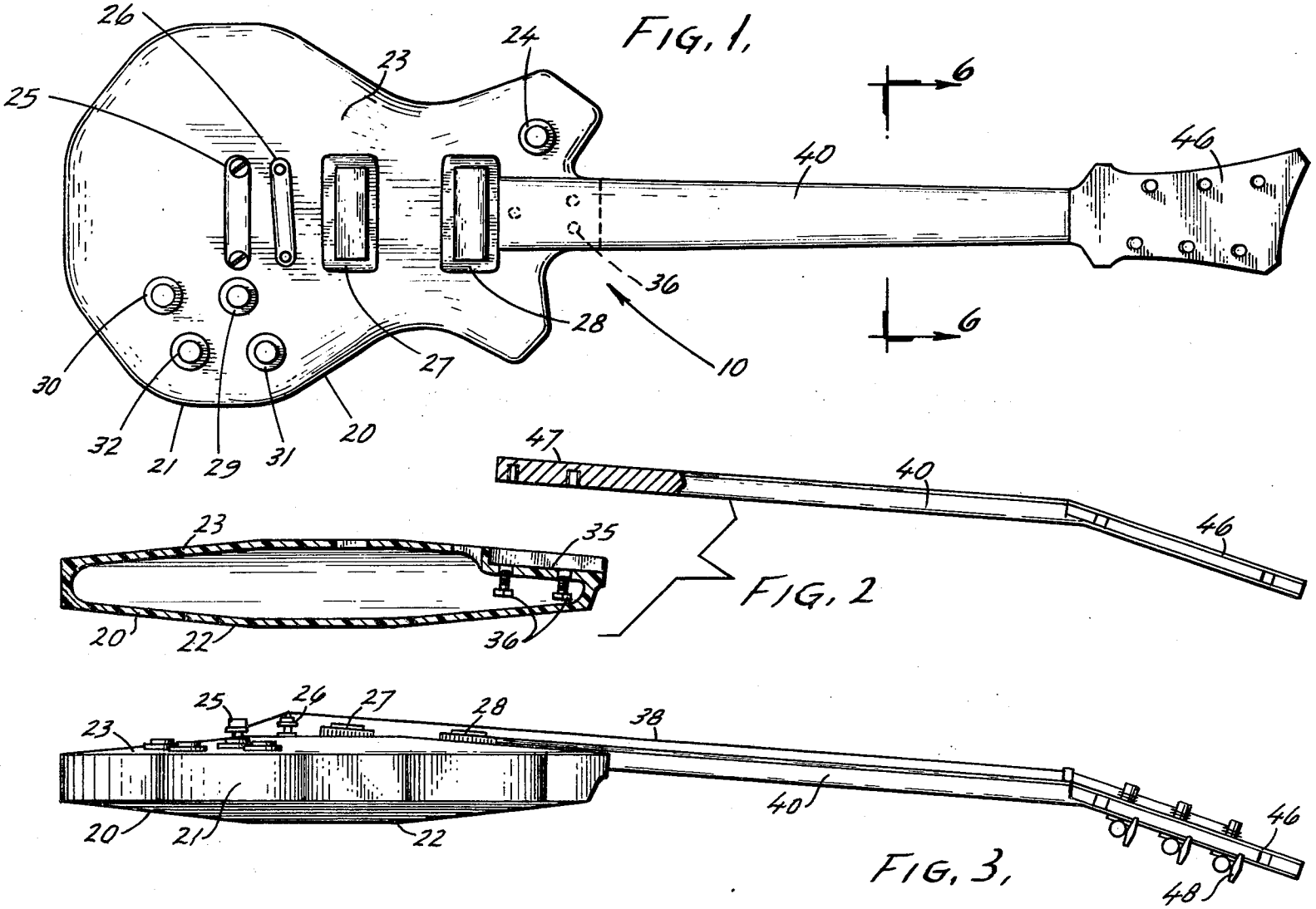
FIG. 1 is a top plan view of a guitar illustrating one embodiment of the present invention.
FIG. 2 is an exploded side view partially in cross-section illustrating the body portion and neck portion of the guitar of FIG. 1.
FIG. 3 is a side elevational view showing the guitar of FIG. 1 in an assembled configuration.

Referring to the drawings, FIG. 1 illustrates one embodiment of the present invention comprising an electric type guitar 10. The guitar 10 comprises a body portion or sound box 20 and a neck 40. As best illustrated in FIGS. 2 and 3, the sound box 20 comprises a seamless, hollow, one piece body including a continuous side wall 21, bottom wall 22 and top wall 23 integrally formed together. The seamless, hollow, integral sound box 20 is made by conventional spin or roto casting techniques which is accomplished by rotating a mold about two axes simultaneously. The mold can be made of silicone rubber materials having a wood grain design formed therein so that the completed or molded sound box 20, when finished, will simulate wood construction. Color can be imparted to the sound box 20 by painting or by incorporating a suitable color into the plastic material prior to the molding. As described in U.S. Pat. No. 2,629,134 issued Feb. 24, 1953, and as adapted for the present invention, in spin and roto casting techniques, a synthetic material such as polyester, polyurethane, epoxy, and the like, is poured into one portion of a two-piece mold, with a catalyst being added immediately prior thereto. The mold is then assembled together and placed in the equipment which rotates the mold about two axes simultaneously. The material adheres to the mold as it is spun or rotated and forms a relatively uniform deposit over the entire inner surface of the mold to produce the seamless, hollow, integral body as illustrated.

In the electric guitar embodiment 10 illustrated in FIG. 1 a sound box is not actually required, but provision must be made for a switch 24, preferably a three-way toggle switch with positions for bass pickup, treble pickup, or both, a tail piece 25, bridge 26, treble pickup 27, bass pickup 28, volume control 29 for the bass pickup, volume control 30 for the treble pickup, tone control 31 for the bass pickup, and tone control 32 for the treble pickup. Accordingly, the body portion 20 is formed with the various electrical components. After the body portion 20 is removed from the mold, any imperfections caused during molding such as flashing where the two mold halves join together, are removed and the recesses formed for receiving the electrical components 24–32 are cut out in preparation for assembly and wiring of the electrical components noted above which are inserted through the larger pick-up 27, 28 and bridge 26 openings.

The neck 40 construction and design is best illustrated in FIGS. 4 and 5. The neck 40 constructed of a laminated hardwood and aluminum assembly so as to produce a rigid member for supporting the string load without the need of a truss or compression rod to prevent deflection of the neck. The neck 40 construction comprises an assembly of an elongated rigid center section 41 preferably made of aluminum, a first side laminate 42, a second side laminate 43, both preferably of hardwood, a top finger board 44 made of hardwood and having the frets 45 arranged therein, and a hardwood tuning head 46. The components of the neck 40, as best illustrated in FIG. 4, are assembled together by means of epoxy adhesive. As illustrated in FIGS. 5 and 6, the aluminum center section 41 extends the entire length of the neck 40 including the tuning head 46, and is visible only from the bottom, the sides and top thereof being covered by the side laminates 42 and 43, the finger board 44 and tuning head 46. As a consequence, the neck 40 provides the feel and appearance of a conventional guitar neck made of wood. The aluminum and hardwood laminate construction of the neck 40 does not permit any significant deflection under a full string load. Grooves 49 are cut into the fingerboard 44 transverse to its length for receiving the frets 45. The laminated construction of the neck 40 provides the feel, weight and balance musicians are accustomed to with the hardwood tuning head 46 contributing greatly to the balance in comparison to prior construction using aluminum or other metals for the tuning head.

As can be seen in FIG. 2, the body portion 20 is formed with a neck saddle 35 therein for receiving the neck 40, the end 47 of the neck 40 fitting in the neck saddle 35 in the body portion 20. As illustrated, screws 36 are used to join the body portion 20 and the neck 40 together, the screws being fixed in place with epoxy adhesive after being tightened. Other suitable means for fastening the neck 40 and body 20 can be used. After the neck 40 and body portion or sound box 20 are assembled together, the strings 38 can be put in place. One end of the strings 38 is fastened to the tail piece 25. The other end is passed over the bridge 26, along the length of the neck 40 and inserted in the tuning pegs 48 in the tuning head 46. The tuning pegs 48 can then be manipulated to adjust the tension of the strings 38 and thereby obtain the desired tone.

If, instead of an electric guitar, a manual or conventional guitar is required, then, as illustrated in FIG. 7, the body portion or sound box 20 is formed with a sound opening 39 therein rather than the recesses 34 for the electrical components, as illustrated in FIG. 1. The body portion or sound box 20 for a conventional or acoustic guitar is made in the same manner as the body portion 20 for an electric guitar. Provision for a tail piece and bridge can be made in the manner described.

While the invention has been described with reference to guitar construction in particular, the same concepts can be applied in the construction of other stringed instruments.

What is claimed is:

1. A body portion or sound box adapted for use with a stringed instrument, said body comprising a relatively homogeneous continuous side wall, bottom wall and top wall integrally formed together to provide a seamless, hollow, one piece body, said body being formed, without any separate structural support, of a synthetic material selected from the group consisting of polyurethane, polyester or epoxy, the internal configuration at the juncture of said walls comprising a radius which is the result of a continuous non-intersecting internal surface and including a neck saddle formed in the end thereof for receiving the neck of a stringed instrument.

2. The body portion of claim 1 adapted for use with an electrical instrument, said body portion including recesses formed in the top thereof for receiving electrical components.

3. The body portion of claim 1 adapted for use with an acoustic instrument, said body portion comprising a sound box and including a sound opening formed in the top thereof.

4. A neck assembly for a stringed instrument, said assembly comprising a laminate including an elongated rigid rectangular center section, a first side laminate in abutting relationship with the center section, a second side laminate in abutting relationship with the opposite side of the center section, the length of the center section extending beyond the length of the side laminates, a fingerboard disposed on top of the center section and side laminates, and a separate tuning head disposed on the portion of the center section extending beyond the side laminates and for receiving tuning pegs, said neck assembly adapted for fastening in the saddle of a body portion or sound box of a stringed instrument.

5. The neck assembly of claim 4 wherein the rigid center section is of aluminum and the fingerboard includes a plurality of grooves formed therein transverse to the length and a plurality of frets arranged within said grooves.

* * * * *